US007116794B2

(12) United States Patent
Westerkull

(10) Patent No.: US 7,116,794 B2
(45) Date of Patent: Oct. 3, 2006

(54) HEARING-AID ANCHORING ELEMENT

(76) Inventor: Patrik Westerkull, Hovashagstig 26A 436 54 Hovas, Gothenburg (SE)

( * ) Notice: Subject to any disclaimer, the term of this patent is extended or adjusted under 35 U.S.C. 154(b) by 103 days.

(21) Appl. No.: 10/981,340

(22) Filed: Nov. 4, 2004

(65) Prior Publication Data

US 2006/0093175 A1 May 4, 2006

(51) Int. Cl.
*H04R 25/00* (2006.01)

(52) U.S. Cl. ..... 381/326; 381/151; 600/25

(58) Field of Classification Search ..... 381/151, 381/326, 329; 600/25, 426; 607/55, 56, 607/57; 606/61, 62, 65, 68, 69, 70, 71, 72, 606/73

See application file for complete search history.

(56) References Cited

U.S. PATENT DOCUMENTS 5,720,766 A * 2/1998 Zang et al. ..... 606/73
6,663,634 B1 * 12/2003 Ahrens et al. ..... 606/73
6,685,728 B1 * 2/2004 Sinnott et al. ..... 606/232
2003/0176866 A1 9/2003 Westerkull

FOREIGN PATENT DOCUMENTS

WO WO 9612451 5/1996
WO WO 0209622 2/2002

* cited by examiner

*Primary Examiner*—Sinh Tran
*Assistant Examiner*—Brian Ensey
(74) *Attorney, Agent, or Firm*—Rolf Fasth; Fasth Law Offices

(57) ABSTRACT

A hearing aid anchoring fixture (104) for anchoring a direct bone conduction hearing aid (108) to the skull bone (106), comprising a threaded portion (110) that has at least one cutting edge (118). Each cutting edge (118) has an adjacent cavity (120) having a volume $V_c$. The threaded portion (110) has a thread depth $d_t$ being half of the difference between the maximum outer diameter $d_1$ of the threaded portion (120) and the inner diameter $d_2$ of the thread, where $d_t$ is at least 10% of the maximum outer diameter $d_1$ of the threaded portion (110) and where $d_t$ is less than 20% of the maximum outer diameter $d_1$ of the threaded portion (110). The fixture (104) may be equipped with a flange portion (114) that has an outer diameter $d_3$ being greater than the maximum diameter $d_1$ of the threaded portion (110).

11 Claims, 5 Drawing Sheets

HEARING-AID ANCHORING ELEMENT

TECHNICAL FIELD

The present invention relates to an anchoring fixture for anchoring a direct bone-conduction hearing-aid to the skull bone.

BACKGROUND OF THE INVENTION

Bone conduction hearing aids are essential for the rehabilitation of patients suffering from hearing losses for which traditional hearing aids are insufficient. Direct bone conduction hearing aids have a vibrating transducer that transmits vibrations directly to a fixture anchored in the bone, i.e. the skin does not take part in the transmission of the vibrations from the vibrator to the fixture in the bone. The most common type of such devices consists of an external hearing aid with a vibrating transducer which, through a coupling, is connected to a skin-penetrating abutment that has an interconnection to a screw shaped fixture anchored in the skull bone. A direct bone conduction hearing aid system may however be designed in other ways.

The fixture is usually made of titanium and is often designed with a flange to prevent the fixture from being pushed through the skull bone in case of a sudden accidental impact.

To insert the fixture into the skull bone a hole is first drilled in the bone. After that the fixture can be screwed into the hole directly since the fixture is traditionally equipped with cutting edges to prepare the thread in the bone. The bone shivers are collected in shiver spaces at the cutting edges on the fixture. If the bone is very hard, a screw tap may be used to prepare the thread or part of the thread before the fixture is inserted. The fixture is then integrated with the skull-bone. This process is called osseointegration. After around 3 months, the osseointegration is usually sufficiently strong so that the fixture can be loaded and used. To achieve a firm and stable anchoring for the hearing aid a strong osseointegration is essential. How well the fixture is anchored to the skull bone is determined by several factors such as the surface characteristics of the fixture, the mechanical design of the fixture and the area of the contact surface between the bone and the fixture. For the osseointegration process to be successful it is also important that the fixture is stable in the bone during the first 3 months when the osseointegration is established. The initial stability of the fixture in the bone is therefore also important for a successful treatment.

The shiver spaces, where the fixture is not in direct bone contact directly after fixture insertion, are also, after a successful osseointegration has taken place, filled with bone tissue that comes in direct contact with the fixture surface in these cavities.

To fixate the skin penetrating abutment to the fixture a connection screw is usually placed through the abutment and then screwed into a threaded hole in the fixture. It is important that this connection screw is sufficiently big to ensure a strong fixation of the abutment.

The thickness of the skull bone is usually between 3–5 mm and the thickness determines the appropriate length of the fixture. A wide fixture offers more contact with the bone but, on the other hand, if it is too wide and short it might be difficult to insert. Therefore, the diameter of the fixtures is usually in the range 3.5–5 mm. To ensure that the biomechanical and osseointegration properties of the fixture are functioning well, the pitch of the thread is often chosen to be in the range of 0.5 to 0.8 mm.

Existing fixtures used for anchoring direct bone conduction hearing aids have a depth of the thread of only around 0.3 mm. The depth of the thread on existing fixtures is less than 10% of the maximum outer diameter of the threaded portion of the fixture which limits the possible area of the contact surface between the fixture and the bone and limits the strength of the anchoring in the bone.

Due to the small depth of the thread on existing fixtures, the drilled hole in the bone has to have a diameter which is quite close to the inner diameter of the thread. Otherwise, there would be a low initial stability of the fixture in the bone. When inserting a fixture in a hole that has a diameter which is quite close to the inner diameter of the thread quite a lot of bone shivers are generated. These bone shivers must be collected mainly in the shivers space cavities at the cutting edges on the fixture. Therefore, these shiver space cavities must be quite big. However, since the fixture includes an inner hole for the connection of, for example, an abutment connection screw, it may be difficult to do the shiver spaces sufficiently deep without interfering with the inner hole in the fixture. This compromise leads to a less optimal design of existing fixtures.

Existing fixtures used for anchoring direct bone conduction hearing aids have a simple quite smooth machined titanium surface. The existing fixtures also have a very thin titanium oxide layer on its surface. These surface characteristics do not present the optimal properties to achieve maximum osseointegration.

Existing fixtures has also a flat surface on the side of the flange facing the threaded portion. A common problem that occurs when the fixture has osseointegrate is that the bone closest to the flange is resorbed which gives a lower stability of the fixture in the bone.

Due to the less optimal macroscopic and microscopic properties of existing fixtures, patients experience several clinical problems. One problem is fixtures that do not osseointegrate properly from the beginning so that the patient has to come back to the hospital to have a new surgical procedure performed. Another problem is that fixtures that have osseointegrated with the bone become loose in the bone due to mechanical load on the fixture. The mechanical load may for example be pulling or rotational forces. In this case a new surgery has also to be performed. The problem with existing fixtures is that the design and the thread profiles have mainly been copied from standard mechanical screws rather than being designed for its clinical, biomechanical and osseointeration purpose. Designing an anchoring system for a lifelong medical rehabilitation requires paying attention to the biological implant interactions with the bone tissue. This is a demanding development work where the lack of optimized key design parameters may lead to the need for patients coming in for surgical procedures, which could have been avoided if the fixture design would have been more favorable from a biomechanical and biological point of view. The existing fixture designs have and have always had problems with for example fixtures coming loose from the skull bone, due to an insufficient interaction with the bone tissue.

There is a need for a more effective anchoring and fixture arrangements that do not have the deficiencies described above.

SUMMARY OF THE INVENTION

The anchoring element of the present invention provides an effective solution to the above-outlined problems with existing fixtures used for anchoring direct bone conduction hearing aids. The thread pitch of the fixture of the present invention is in the range 0.5 to 0.8 mm. This size of the pitch has shown to be optimal for osseointegrated fixtures from a biomechanical point of view.

The fixture of the present invention has a depth of the thread that is at least 10% of the maximum diameter of the threaded portion of the fixture. The depth of the threaded portion is however not greater than 20% of the maximum diameter of the thread of the fixture. By designing the depth of the thread in this interval, several significant and surprising advantages can be achieved for a fixture intended to be used for anchoring direct bone conduction hearing aids. The improvements are both on the microscopic and the macroscopic level. On a microscopic level, the increased surface offers an increased contact surface between the bone tissue and the fixture and this will contribute to a higher removal torque if forces directed to screw out the fixture from the bone is applied to the fixture when the fixture is osseointegrated. On a macroscopic level, the increased depth of the thread results in a firmer grip in the bone if trying to pull the fixture out of the hole.

By keeping the thread depth in this range significant improvements to the surgical procedure are achieved. A fixture having a thread that is at least 10% of the maximum diameter of the threaded portion of the fixture is inserted in a drilled hole in the bone where the drilled hole has a significantly larger diameter than the inner diameter of the thread, without compromising the initial stability of the fixture compared to existing fixtures. Another advantage with the fixture of the present invention is that if it is inserted into a drilled hole in the bone which has significantly larger diameter than the inner diameter of the thread, there will be a space between the bottom of the thread grove on the fixture and the bone, when it has been inserted into the hole in the bone. This allows bone shivers to be collected in a helix-shaped space along the thread of the fixture in the bottom of the thread groove and contributes to the accommodation of the cut off and compressed bone material. The insertion of the fixture into a larger hole in the bone had the surprising result of requiring a further reduced amount of torque when the fixture is inserted into the bone. One reason for this is the ability of the fixture to collect bone material along the thread groove.

Keeping the depth of the threaded portion to less than 20% of the maximum diameter of the threaded portion of the fixture is essential so that the thread profile of the fixture does not become too weak from a mechanical point of view. A thread deeper than this might also complicate the manufacturing procedure for the fixture. By keeping the depth of the threaded portion to less than 20% of the maximum diameter of the threaded portion of the fixture there will also be sufficient volume in the center of the fixture to accommodate a sufficient inner hole for attaching the hearing aid abutment in a stable way.

The unique advantages of the fixture of the present invention are achieved by having a thread depth that is specifically in the range 10% to 20% of the maximum diameter of the threaded portion of the fixture. The advantages of this on both macroscopic and microscopic level offer significant clinical advantages for patients in need of direct bone conduction hearing aid. The anchoring of the fixture is significantly stronger and therefore the risk for the fixture to become loose is reduced.

The important advantages mentioned above have never been achieved and could never have been achieved with existing fixture designs. The present invention solves several drawbacks with existing solutions and significantly improves the clinical outcome of the rehabilitation of patients in need for a direct bone conduction hearing aid.

The fixture of the present invention has at least one cutting edge and each cutting edge may have an adjacent cavity where bone shivers may be collected. If there are more cavities the volume of each cavity may be less than if there are fewer cavities. The cavities on a fixture with more than one cavity do not necessarily have to be identical although this may be a preferred solution. To define the total volume of these cavities it may be assumed that the fixture is manufactured in a machining process although the present invention is not limited to this type of manufacturing process.

The total volume of the cavities may then be defined as: the total volume of a fixture where the machining procedure for creating the cavities has not been performed, minus the total volume of the same fixture but where the machining procedure for creating the cavities has been completed. Another way of describing this volume is to assume that the total volume of the cavities is the total volume of the fixture material that is be removed from the fixture when these cavities are created in a machining process if this machining process is done as the last machining process in the manufacturing of the final shape of the fixture i.e. after the creation of the thread.

In the present invention, the total volume of the cavities may be greater than 50% of the cut off bone volume when the fixture has been screwed into a hole in the bone where the hole has a diameter which is 10% greater than the inner diameter of the thread. This provides a sufficient collection of bone shivers in the cavities since bone shivers may in this case also be collected along the thread as described above.

In a preferred procedure, the present invention involves a preparation of the hole in the bone using a drill with a diameter that is at least 10% wider and not more than 20% wider than the inner diameter of the thread of the fixture. In this way, the amount of bone shivers as well as the insertion torque for the fixture is limited. Since the inner diameter of the thread is smaller than the diameter of the drilled hole, bone shivers can also be collected in the space between the bone and the inner diameter of the thread of the fixture. In this way, the amount of bone shivers that need to be collected in the cavities on the fixture can be kept down. A hole with a diameter greater than 20% wider than the inner diameter of the thread of the fixture may lead to a poor initial stability of the fixture.

In a preferred embodiment, the threaded portion may have relieving surfaces behind the cutting edges. The relieving reduces the friction between the fixture and the bone at the part of the fixture that follows the cutting edge when the fixture is screwed into the bone.

In another preferred embodiment, the threaded portion may have a relieving portion at its distal end and where this relieving portion has a slightly smaller outer diameter of the thread than the maximum outer diameter of the threaded portion. This relieving reduces the friction between the fixture and the bone at the distal part of the threaded portion and therefore contributes to a lower insertion torque when inserting the fixture in the bone.

In a preferred embodiment the fixture has a titanium oxide layer with a thickness of at least 100 nm on the surface of the threaded portion. By having a thicker titanium oxide layer, the surface of the threaded portion will show improved osseointegration properties since titanium oxide is a biomaterial that interacts with the living bone tissue in a way that contributes to a strong osseointegration. Due to the fact that a fixture anchored in the skull bone is quite short, it is especially important for patients in need for a direct bone conduction hearing aid, that the strength of the osseointegration bond between the fixture and the bone tissue is high. With a strong osseointegration the risk for clinical complications for these patients is significantly reduced.

In a preferred embodiment, the porous titanium oxide has a porous structure since this further improves the osseointegration properties by allowing a bone tissue to interact even further with the titanium oxide. The titanium oxide on the fixture surface may well include or be covered by other chemical or biological substances to even further improve the osseointegration.

In a preferred embodiment of the present invention, the surface of the threaded portion of the fixture may have an average surface roughness $S_a$ where $1\ \mu m \leqq S_a \leqq 3\ \mu m$. This surface roughness may increase the contact surface between the fixture and the bone tissue and will further contribute to an improved strength of the osseointegration of the fixture in the bone.

In a preferred embodiment the fixture of the present invention presents at least one groove extending at least one turn on the side of the flange facing the threaded portion. This arrangement acts as a micro thread in contact with the bone. Since bone resorbtion starts in the periphery of the flange, this arrangement hinders the bone resorbtion under the flange. The thread is hindering the bone resorbtion from going further down along the threaded portion in contra distal direction.

DETAILED DESCRIPTION

Figure 1:
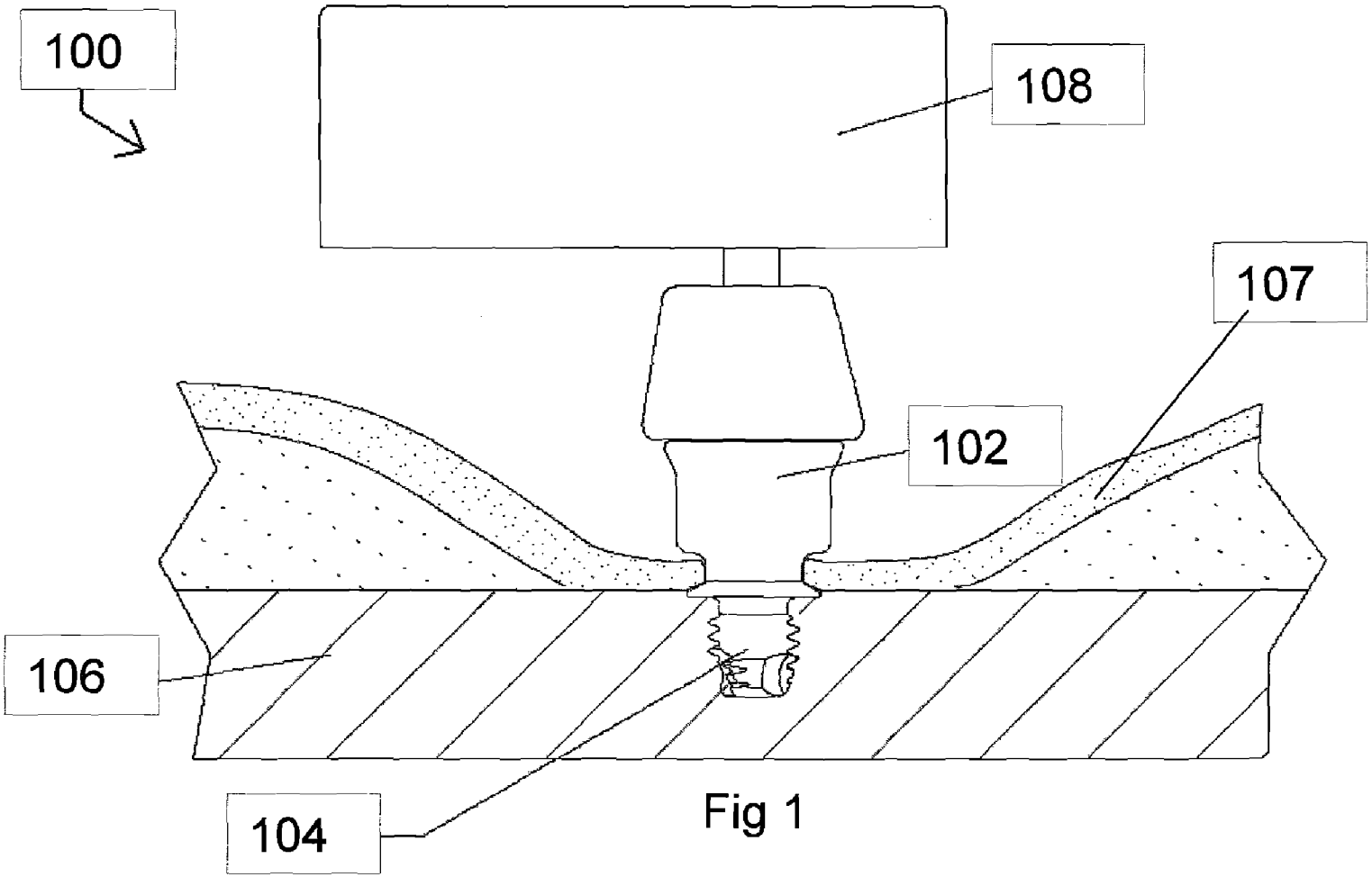
FIG. 1 is a side view of the hearing aid of the present invention built into an example of a direct bone conduction hearing aid system.

FIG. 1 is a side view of an illustrative example of a direct bone conduction hearing aid system 100 that has an abutment 102 with a fixture 104 that is screwed into a skull bone 106 of a user. A hearing-aid device 108 converts sound into vibrations and the vibrations is transferred to the skull bone 106.

Figure 2:
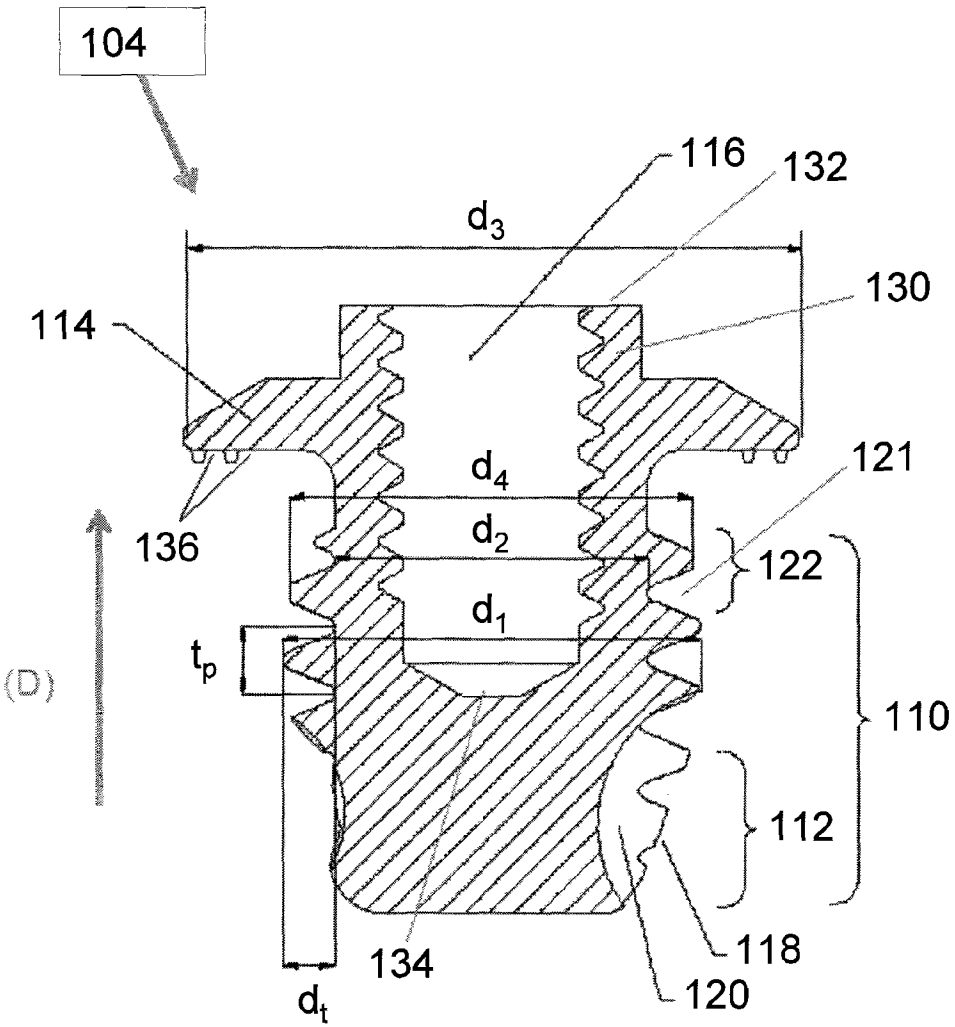
FIG. 2 is a cross-sectional side view of a preferred embodiment of the fixture of the present invention.
Figure 4:
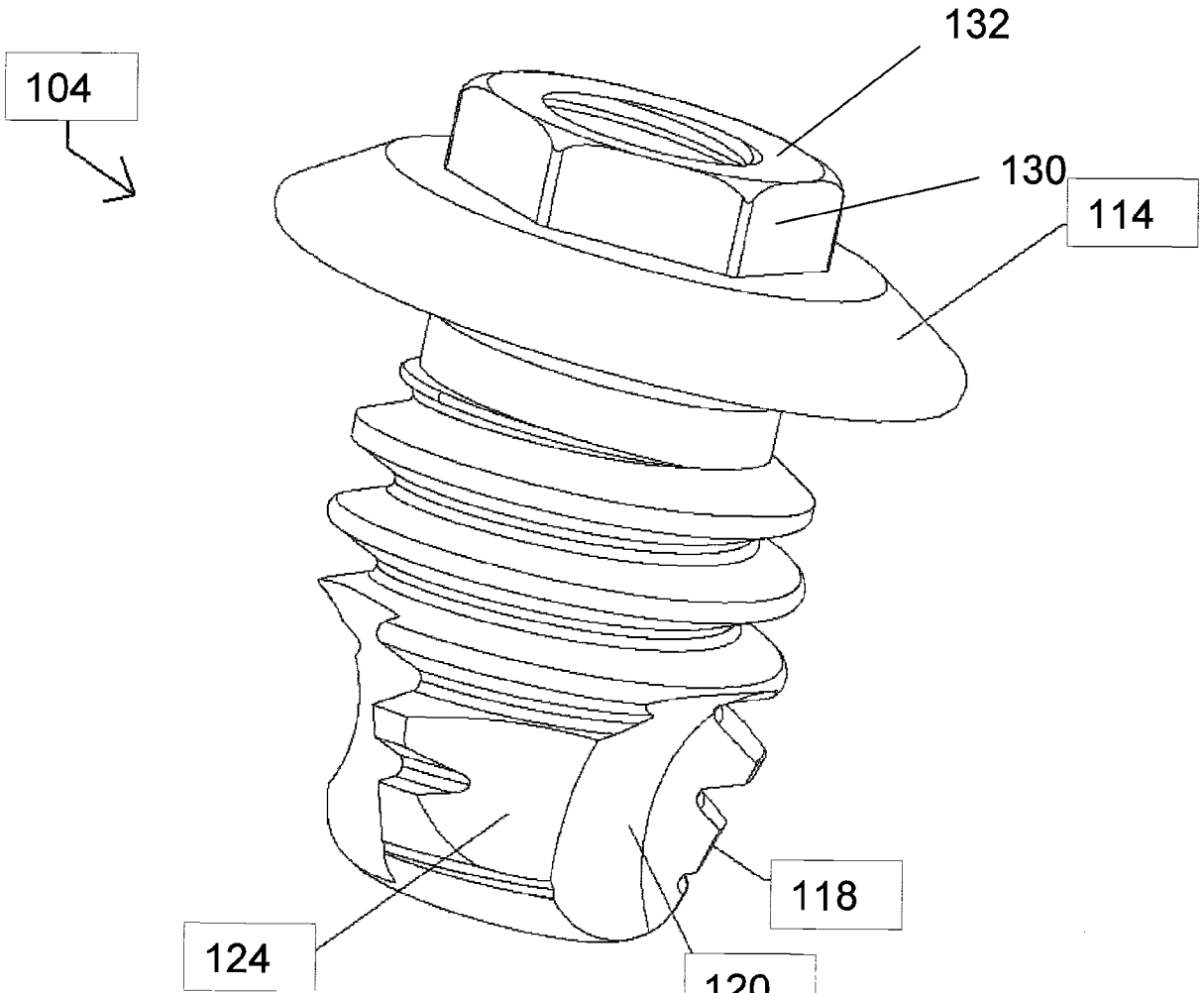
FIG. 4 is a perspective view of the fixture shown in FIG. 2.

FIG. 2 is a cross-sectional side view and FIG. 4 is a perspective view of a preferred embodiment of the fixture 104. The fixture 104 has a threaded portion 110 having a maximum outer diameter $d_1$ and an inner diameter $d_2$. The thread has a depth $d_t$ and a thread pitch $t_p$. The fixture has a conical outer portion 112 to facilitate the insertion of the fixture 104 into a hole in the skull bone 106.

An upper end of the fixture 104 has a radially outwardly protruding flange 114 with a diameter $d_3$ to prevent the fixture 104 from being pushed into the skull. Preferably, the diameter $d_3$ is greater than the diameter $d_2$. An axial extension 130 has an axial threaded inner hole 116 defined therein. The hole 116 extends from an upper surface 132 of the extension to a conical shaped bottom 134. The hole may be used for receiving, for example, a connection screw for connecting the fixture 104 to the abutment 102. The side of the flange 114 facing the threaded portion 110 has grooves 136. The conical outer end 112 of the fixture 104 has cutting edges 118. The cutting edges 118 have cavities 120 defined therein. The cutting edges 118 may be used to cut a thread in the bone as the fixture 104 is screwed into the skull bone 106. The bone shivers from the skull bone 106 may then be collected in the cavities 120 that provide a space for the shivers. The thread has a thread groove 121 defined therein.

The threaded portion 110 has a relieving portion 122 at the distal end and positioned below the flange 114 but above the outer end 112. The distal direction is represented by the arrow (D). The relieving portion 122 has an outer diameter $d_4$ that, preferably, is smaller than the maximum outer diameter $d_1$ of the threaded portion 110.

Figure 3:
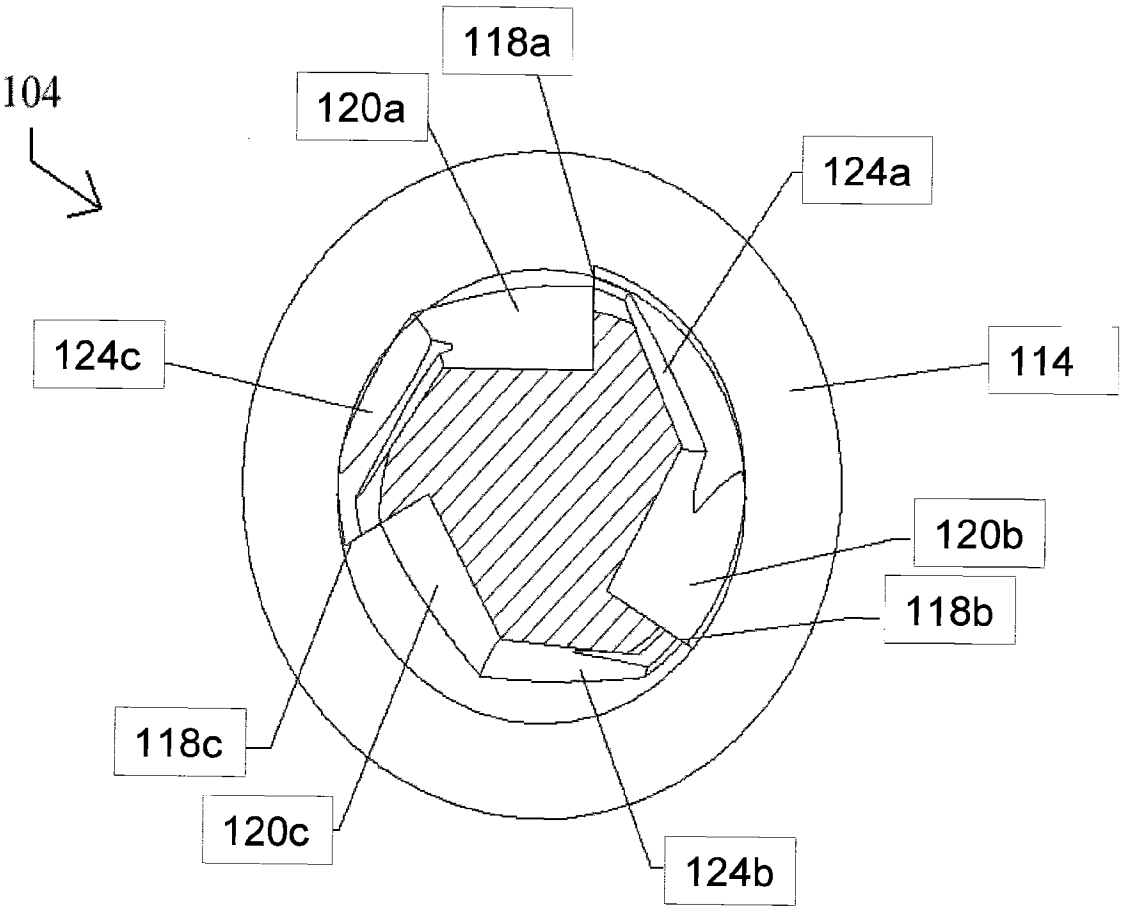
FIG. 3 is a cross-sectional bottom view of the embodiment along line 3—3 shown in FIG. 2.

FIG. 3 is a cross-sectional bottom view of the embodiment showed along line 3—3 in FIG. 2. The fixture has relieving surfaces $\mathbf{124}_{abc}$ behind each of the cutting edges $\mathbf{118}_{abc}$, respectively. The cutting edges $\mathbf{118}_{abc}$ have adjacent cavities $\mathbf{120}_{abc}$, respectively. As the cutting edges 118 cuts into the skull bone 106 when outer end 112 is screwed into the skull bone, the bone shiver may be deposited into the cavities 120 and relieving surfaces 124.

Figure 5:
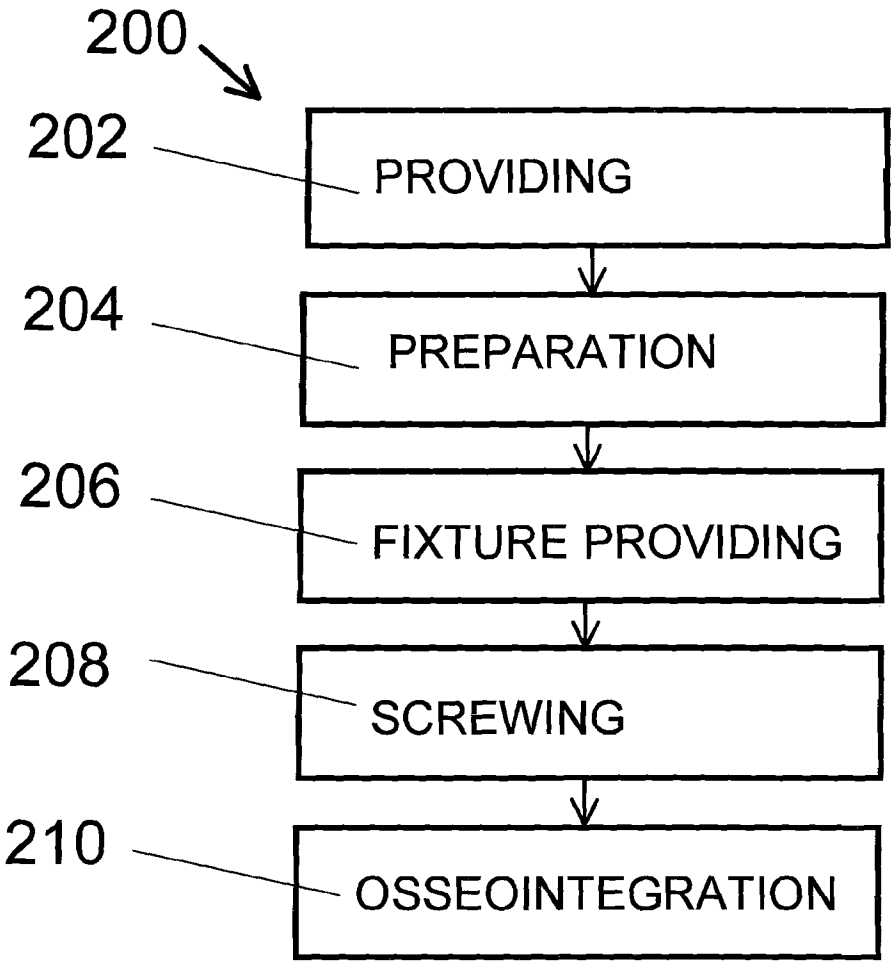
FIG. 5 is a flowchart of a preferred method of using the fixture of the present invention.

FIG. 5 is a flow chart of a preferred embodiment and illustrates a preferred insertion method for inserting the fixture in the skull bone. The method 200 has a providing step 202 for providing a drill that has a diameter that is 10–20% wider than the diameter $d_2$ of the fixture. In a preparation step 204, a hole is prepared in the skull bone by drilling the hole with the drill. In a fixture providing step 206, a direct bone conduction hearing-aid fixture is provided that has a thread depth $d_t$ where $d_t$ is greater than 10% of the diameter $d_1$. In a screwing step 208, the fixture is screwed into the hole in the skull bone. In an osseointegration step 210, the screw is left in the skull bone until the fixture is fully osseointegrated with the skull bone.

While the present invention has been described in accordance with preferred compositions and embodiments, it is to be understood that certain substitutions and alterations may be made thereto without departing from the spirit and scope of the following claims.

The invention claimed is:

1. A hearing aid anchoring fixture for anchoring a direct bone conduction hearing aid to a skull bone, comprising:

a threaded portion having a cutting edge, the cutting edge having a cavity defined therein, the cavity being adjacent to the cutting edge and having a volume $V_c$;

the threaded portion having a maximum outer diameter $d_1$ and an inner diameter $d_2$;

a thread having a thread depth $d_t$ being half of a difference between the maximum outer diameter $d_1$ of the threaded portion and the inner diameter $d_2$ of the thread, where $d_t$ is between 10% and 20% of the maximum outer diameter of the threaded portion, the threaded portion having a surface layer, the surface layer having a thickness greater than 100 nanometers; and a flange disposed at one end portion of the hearing aid anchoring fixture, the flange having a surface facing the threaded portion, the surface having a groove defined therein, the hearing aid fixture having a thread pitch $t_p$, in an interval $0.5\ mm \leqq t_p \leqq 0.8\ mm$.

2. The hearing aid anchoring fire according to claim 1, wherein the volume $V_c$ of the cavity is greater than 50% of a cut-off bone volume when the fixture has been screwed into a hole in the bone having a diameter that is 10% greater than the inner diameter $d_2$ of the thread.

3. The hearing aid anchoring fixture according to claim 1 wherein the fixture has a plurality of cutting edges where each cutting edge has an adjacent cavity defined therein.

4. The hearing aid anchoring fixture according to claim 3, wherein total volume $V_{ctot}$ of the cavities is greater than 50% of the cut-off bone volume when the fixture has been screwed into a hole in the bone having a diameter that is 10% greater than the inner diameter $d_2$ of the thread.

5. The hearing aid anchoring fixture according to claim 1, wherein the threaded portion has a relieving surface disposed behind the cutting edge.

6. The hearing aid anchoring fixture according to claim 3, wherein the threaded portion has relieving surfaces disposed behind each of the cutting edges.

7. The hearing aid anchoring fixture according to claim 1, wherein the threaded portion has a relieving portion at a distal end of the threaded portion and wherein the relieving portion has a smaller outer diameter $d_4$ than the maximum outer diameter $d_1$ of the threaded portion.

8. The hearing aid anchoring fixture according to claim 1, wherein the threaded portion has a titanium oxide layer having a thickness that is at least 100 nm.

9. A hearing aid anchoring fixture for anchoring a direct bone conduction hearing aid to a skull bone, comprising:

a threaded portion having a cutting edge, the cutting edge having a cavity defined therein, the cavity being adjacent to the cutting edge and having a volume $V_c$;

the threaded portion havinga maximum outer diameter $d_1$ and an inner diameter $d_2$;

a thread having a thread depth $d_t$ being half of a difference between the maximum outer diameter $d_1$ of the threaded portion and the inner diameter $d_2$ of the thread. where $d_t$ is between 10% and 20% of the maximum outer diameter of the threaded portion;

the threaded portion having a surface layer, the surface layer having a thickness greater than 100 nanometers; and a flange disposed at one end portion of the hearing aid anchoring fixture, the flange having a surface facing the threaded portion, the surface having a groove defined therein;

The surface layer including titanium oxide having a thickness that is at least 100 nm, the titanium oxide surface layer having a porous structure.

10. The hearing aid anchoring fixture according to claim 9, wherein the treaded portion has a surface roughness $S_a$, where $1\ \mu m \leqq S_a \leqq 3\ \mu m$.

11. The hearing aid anchoring fixture according to claim 9, wherein the groove extends at least one turn on a side of the flange facing the threaded portion.

* * * * *